US011506988B2

(12) United States Patent
Takahashi

(10) Patent No.: US 11,506,988 B2
(45) Date of Patent: Nov. 22, 2022

(54) ELECTROPHOTOGRAPHIC PHOTOSENSITIVE MEMBER, ELECTROPHOTOGRAPHIC IMAGE FORMING APPARATUS, AND METHOD OF PRODUCING ELECTROPHOTOGRAPHIC PHOTOSENSITIVE MEMBER

(71) Applicant: CANON KABUSHIKI KAISHA, Tokyo (JP)

(72) Inventor: Koji Takahashi, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 86 days.

(21) Appl. No.: 17/209,503

(22) Filed: Mar. 23, 2021

(65) Prior Publication Data

US 2021/0302849 A1 Sep. 30, 2021

(30) Foreign Application Priority Data

Mar. 30, 2020 (JP) ..... JP2020-061525

(51) Int. Cl.

| | |
|---|---|
| ***G03G 5/08*** | (2006.01) |
| ***G03G 15/02*** | (2006.01) |
| ***G03G 5/05*** | (2006.01) |
| ***G03G 5/147*** | (2006.01) |

(52) U.S. Cl.

CPC ..... *G03G 5/08* (2013.01); *G03G 5/05* (2013.01); *G03G 5/0507* (2013.01); *G03G 5/0525* (2013.01); *G03G 5/14704* (2013.01); *G03G 15/0233* (2013.01)

(58) Field of Classification Search

CPC ..... G03G 5/08; G03G 5/05; G03G 5/0507; G03G 5/0525; G03G 5/14704; G03G 15/0233

See application file for complete search history.

(56) References Cited

U.S. PATENT DOCUMENTS

| | | | |
|---|---|---|---|
| 8,457,528 | B2 | 6/2013 | Ochi et al. |
| 8,865,380 | B2 | 10/2014 | Noguchi et al. |
| 9,114,565 | B2 | 8/2015 | Kawai et al. |
| 9,389,521 | B2 | 7/2016 | Takahashi et al. |
| 9,766,561 | B2 | 9/2017 | Takahashi et al. |
| 9,772,596 | B2 | 9/2017 | Mitsui et al. |
| 10,042,273 | B2 | 8/2018 | Takahashi et al. |

(Continued)

FOREIGN PATENT DOCUMENTS

| | | | |
|---|---|---|---|
| JP | 2011-118046 A | | 6/2011 |
| JP | 2011118046 A | * | 6/2011 |

(Continued)

*Primary Examiner* — Ryan D Walsh

(74) *Attorney, Agent, or Firm* — Venable LLP

(57) ABSTRACT

Provided is an electrophotographic photosensitive member, which has high abrasion resistance and is resistant to being deeply flawed. Specifically, provided is an electrophotographic photosensitive member comprising a support and a surface layer formed on the support, wherein the surface layer comprises at least inorganic particles having pores in surfaces thereof, wherein at least a resin in the surface layer penetrates the pores, and wherein when vibration having a frequency of 0.5 Hz is applied to the surface layer at 28° C., the loss tangent tan δ of the dynamic viscoelasticity of the surface layer is from 0.005 to 0.05.

10 Claims, 1 Drawing Sheet

(56) References Cited

U.S. PATENT DOCUMENTS

| | | | |
|---|---|---|---|
| 10,429,754 | B2 | 10/2019 | Takahashi et al. |
| 2014/0093281 | A1 | 4/2014 | Takahashi et al. |
| 2014/0106269 | A1 | 4/2014 | Tanaka |
| 2020/0241434 | A1 | 7/2020 | Takahashi et al. |

FOREIGN PATENT DOCUMENTS

| | | | | |
|---|---|---|---|---|
| JP | 2014-95888 | A | 5/2014 | |
| JP | 2017-49523 | A | 3/2017 | |
| WO | WO-2016047270 | A1 * | 3/2016 | ..... G03G 15/0233 |

* cited by examiner

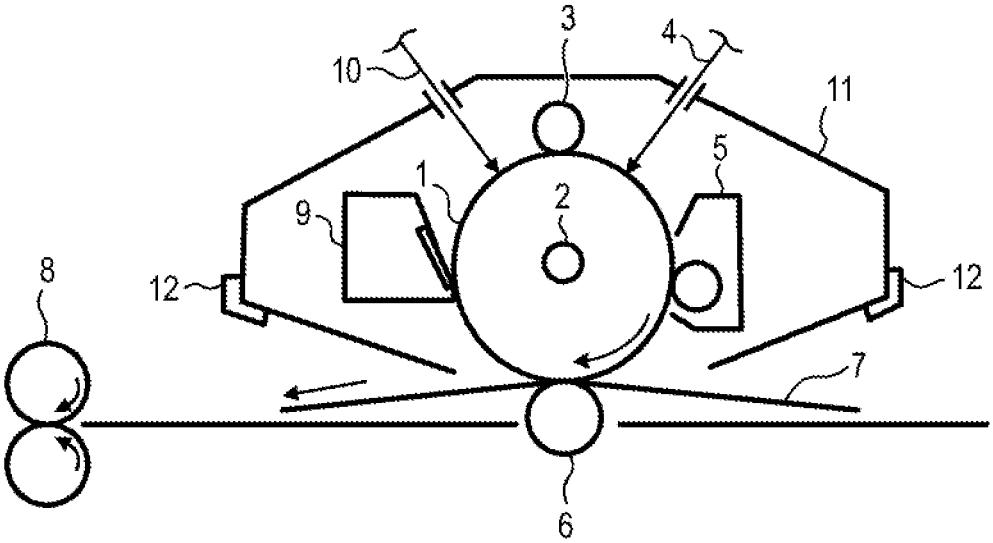
3
4
10
11
5
1
2
9
8
12
12
7
6

ELECTROPHOTOGRAPHIC PHOTOSENSITIVE MEMBER, ELECTROPHOTOGRAPHIC IMAGE FORMING APPARATUS, AND METHOD OF PRODUCING ELECTROPHOTOGRAPHIC PHOTOSENSITIVE MEMBER

BACKGROUND OF THE INVENTION

Field of the Invention

The present disclosure relates to an electrophotographic photosensitive member, an electrophotographic image forming apparatus (hereinafter also referred to as "electrophotographic apparatus") comprising a process cartridge comprising the electrophotographic photosensitive member, and a method of producing the electrophotographic photosensitive member.

Description of the Related Art

In recent years, the diversification of the users of electrophotographic apparatus has been advancing, and hence an image to be output has been required to have image quality higher than ever before and to show no change in image quality during the usage period of any such apparatus.

As a technology for the suppression of image smearing over a long time period, in Japanese Patent Application Laid-Open No. 2014-095888, there is a disclosure of a technology concerning an electrophotographic photosensitive member comprising a surface layer comprising particles obtained by causing a specific compound to adsorb to silica particles.

In addition, as a technology of achieving both of abrasion resistance and white light fastness, in Japanese Patent Application Laid-Open No. 2017-049523, there is a disclosure of a technology concerning an electrophotographic photosensitive member that comprises a surface layer comprising specific silica particles and a specific leveling agent, and whose surface has a coefficient of dynamic friction of 0.25 or less.

Further, as a technology comprising using an additive for the suppression of image smearing that has no adverse effects on both of durability and electrical characteristics, in Japanese Patent Application Laid-Open No. 2011-118046, there is a disclosure of a technology concerning a method of producing an electrophotographic photosensitive member comprising using a coating liquid for an outermost surface layer comprising porous particles each comprising such additive.

Meanwhile, it is also important that the abrasion amount of an electrophotographic photosensitive member (hereinafter also referred to as "photosensitive member") be reduced for reducing a change in image quality during its usage period.

An investigation by the inventors has found that each of the electrophotographic photosensitive members described in Japanese Patent Application Laid-Open No. 2014-095888, Japanese Patent Application Laid-Open No. 2017-049523, and Japanese Patent Application Laid-Open No. 2011-118046 comprises inorganic particles, and hence involves the following problem. The film of the photosensitive member is brittle, and hence the abrasion resistance thereof is insufficient, or the photosensitive member is deeply flawed by its long-term use.

Therefore, an object of the present disclosure is to provide an electrophotographic photosensitive member that can be reduced in abrasion amount despite comprising inorganic particles.

SUMMARY OF THE INVENTION

The above-mentioned object is achieved by the present disclosure described below. That is, according to the present disclosure, there is provided an electrophotographic photosensitive member comprising: a support; and a surface layer formed on the support, wherein the surface layer comprises inorganic particles having pores in surfaces thereof, wherein at least a resin in the surface layer penetrates the pores, and wherein when vibration having a frequency of 0.5 Hz is applied to the surface layer at 28° C., a loss tangent tan δ of dynamic viscoelasticity of the surface layer is from 0.005 to 0.05.

Further features of the present invention will become apparent from the following description of exemplary embodiments with reference to the attached drawing.

BRIEF DESCRIPTION OF THE DRAWINGS

FIGURE is a view for illustrating an example of the schematic configuration of an electrophotographic apparatus comprising a process cartridge comprising an electrophotographic photosensitive member.

DESCRIPTION OF THE EMBODIMENTS

The present disclosure is described in detail below by taking an exemplary embodiment. The description "from ○○ to xx" representing a numerical range means a numerical range including a lower limit and an upper limit that are end points unless otherwise stated.

An electrophotographic photosensitive member according to the present disclosure is an electrophotographic photosensitive member comprising a support and a surface layer formed on the support, the photosensitive member being characterized in that the surface layer comprises inorganic particles having pores in surfaces thereof and a resin, that at least the resin in the surface layer penetrates the pores, and that when vibration having a frequency of 0.5 Hz is applied to the surface layer at 28° C., the loss tangent tan δ of the dynamic viscoelasticity of the surface layer is from 0.005 to 0.05.

An investigation by the inventors has found that in the configuration described in Japanese Patent Application Laid-Open No. 2014-095888, Japanese Patent Application Laid-Open No. 2017-049523, or Japanese Patent Application Laid-Open No. 2011-118046, the surface layer comprises inorganic particles, and is hence increased in hardness, but becomes brittle as a film. Accordingly, the inventors have found that depending on an environment where the electrophotographic photosensitive member described in any such literature is used, the surface layer of the electrophotographic photosensitive member may be unable to obtain sufficient abrasion resistance, or a deep flaw or the like may occur in the surface layer of the electrophotographic photosensitive member.

To solve the problems that have occurred in the above-mentioned related art, the inventors have paid attention to the physical properties of the surfaces of the inorganic particles in the surface layer and of the surface layer, and have made an investigation. As a result, the inventors have found that the abrasion of the surface layer that has occurred in the related art can be reduced by: incorporating, into the surface layer, inorganic particles having pores in their surfaces; causing at least a resin in the surface layer to penetrate the inside of the pores; and setting the loss tangent tan δ of the dynamic viscoelasticity of the surface layer when vibration having a frequency of 0.5 Hz is applied thereto at 28° C. to from 0.005 to 0.05.

The inventors have considered the mechanism via which the abrasion of the surface layer of the electrophotographic photosensitive member that is a problem of the related art is reduced by the configuration of the present disclosure to be as described below.

The surface layer comprising the inorganic particles is reduced in elasticity, and hence becomes brittle as a film. Accordingly, the layer may not have sufficient abrasion resistance, or may be deeply flawed by its use. When the inorganic particles having the pores in their surfaces are used, at least the resin in the surface layer penetrates the pores to fix the inorganic particles to the surface layer, and the loss tangent tan δ of the dynamic viscoelasticity of the surface layer when the vibration having a frequency of 0.5 Hz is applied thereto at 28° C. is set to 0.005 or more, viscosity occurs in the film to alleviate its brittleness.

The fact that the inorganic particles having the pores in their surfaces are used, and at least the resin in the surface layer penetrates the pores, and the configuration in which the loss tangent tan δ of the dynamic viscoelasticity of the surface layer when the vibration having a frequency of 0.5 Hz is applied thereto at 28° C. is from 0.005 to 0.05 mutually affect each other like the foregoing mechanism to enable the achievement of the effects of the present disclosure.

<With Regard to Inorganic Particles>

The surface layer of the electrophotographic photosensitive member of the present disclosure comprises the inorganic particles having the pores in their surfaces. Examples of the inorganic particles include silicon oxide (silica, $SiO_2$), magnesium oxide, zinc oxide, lead oxide, aluminum oxide (alumina, $Al_2O_3$), zirconium oxide, tin oxide, titanium oxide (titania), niobium oxide, molybdenum oxide, and vanadium oxide each having pores in the surface thereof. Of those, from the viewpoints of a hardness, an insulating property, and light transmittance, silicon oxide and aluminum oxide are preferred.

The average primary particle diameter of the inorganic particles may be selected from the viewpoint of the occurrence of a black dot or a white dot in an image printed with the electrophotographic photosensitive member, or the suppression of a crack in the electrophotographic photosensitive member. Inorganic particles having an average primary particle diameter of from 1 μm to 6 μm are preferably used from the viewpoint of the film property of the surface layer and the viewpoint of more efficiently suppressing the shaving thereof.

To more efficiently cause the resin to penetrate the pores of the inorganic particles, the specific surface area of the inorganic particles is preferably from 300 $m^2/g$ to 1,000 $m^2/g$.

<With Regard to Method of causing Resin to penetrate Pores>

A method of causing the resin to penetrate the pores of the inorganic particles in the present disclosure is described.

First, the inorganic particles having the pores in their surfaces, the resin, and a solvent, and as required, a charge-transporting material, an additive, or the like are mixed and stirred to prepare a coating liquid for a surface layer. Subsequently, the coating liquid for a surface layer is transferred to a container whose inside can be decompressed. The resin component in the coating liquid for a surface layer is caused to penetrate the inside of the pores by bringing the container into a decompressed state to deaerate the coating liquid for a surface layer, thereby removing air in the pores. After that, the coating liquid for a surface layer is applied and dried to form such a surface layer that at least the resin has penetrated the inside of the pores of the inorganic particles. In addition to the resin, the charge-transporting material, the additive, the remaining solvent, or the like may penetrate the inside of the pores of the inorganic particles.

A pressure at the time of the decompression is preferably brought into a decompressed state of 0.05 MPa or less for sufficiently causing the resin to penetrate the inside of the pores. Further, the deaeration is preferably performed under a decompressed state of 0.05 MPa or less for a time period of 10 minutes or more.

The viscosity of the coating liquid in the present disclosure at the time of the decompression is preferably 500 mPa·s or less.

When the viscosity or the like of the coating liquid for a surface layer is changed by the decompression, the viscosity of the coating liquid may be adjusted to a preferred value after the completion of the decompression.

When the coating liquid for a surface layer comprises a plurality of solvents comprising a solvent having a boiling point of less than 100° C., the resin component in the coating liquid for a surface layer may be caused to penetrate the pores by the following method.

First, a component of the surface layer is dissolved in a solvent having a boiling point of 100° C. or more in which the component of the surface layer is soluble. After that, the inorganic particles having the pores in their surfaces are added to the solution, and the mixture is stirred. Subsequently, the resultant coating liquid for a surface layer is transferred to a container whose inside can be decompressed, and the resin component in the coating liquid for a surface layer is caused to penetrate the inside of the pores by decompressing the inside of the container to remove the air in the pores. After that, the solvent having a boiling point of less than 100° C. is added to the coating liquid, and the mixture is stirred again.

The use of the method can suppress the change in viscosity or the like.

<With Regard to Loss Tangent tan δ>

The loss tangent tan δ (hereinafter also referred to as "tan δ") of the dynamic viscoelasticity of the surface layer in the present disclosure when the vibration having a frequency of 0.5 Hz is applied thereto at 28° C. is from 0.005 to 0.05.

When the tan δ is from 0.005 to 0.05, coupled with the penetration of at least the resin in the surface layer into the pores of the surfaces of the inorganic particles, a balance between the viscosity and elasticity of the surface layer is maintained, and hence the brittleness of a film made of the surface layer is alleviated. Probably as a result of the foregoing, the abrasion of the surface layer may be reduced. The tan δ is preferably from 0.01 to 0.05.

The tan δ of the surface layer is measured by the following method.

First, a measurement sample measuring 20 μm thick by 5 mm wide by 20 mm long is cut out of the surface layer. Then, the tan δ of the sample at 0.5 Hz and 28° C. is measured with a viscoelasticity spectrometer EXSTAR DMS6100 manufactured by SII Nano Technology Inc.

[Electrophotographic Photosensitive Member]

The electrophotographic photosensitive member of the present disclosure comprises the support and a photosensitive layer, and in some cases, a protective layer. Of those, the photosensitive layer or the protective layer serves as the surface layer.

A method of producing the electrophotographic photosensitive member of the present disclosure is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<Support>

In the present disclosure, the electrophotographic photosensitive member comprises a support. In the present disclosure, the support is preferably a conductive support having conductivity. In addition, examples of the shape of the support include a cylindrical shape, a belt shape, and a sheet shape. Of those, a cylindrical support is preferred. In addition, the surface of the support may be subjected to, for example, electrochemical treatment, such as anodization, blast treatment, or cutting treatment.

A metal, a resin, glass, or the like is preferred as a material for the support.

Examples of the metal include aluminum, iron, nickel, copper, gold, stainless steel, and alloys thereof. Of those, an aluminum support using aluminum is preferred.

In addition, conductivity may be imparted to the resin or the glass through treatment involving, for example, mixing or coating the resin or the glass with a conductive material.

<Conductive Layer>

In the present disclosure, a conductive layer may be arranged on the support. The arrangement of the conductive layer can conceal a flaw and unevenness on the surface of the support, and can control the reflection of light on the surface of the support.

The conductive layer preferably comprises conductive particles and a resin.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, the metal oxide is preferably used as the conductive particles. In particular, titanium oxide, tin oxide, or zinc oxide is more preferably used.

When the metal oxide is used as the conductive particles, the surface of the metal oxide may be treated with a silane coupling agent or the like, or the metal oxide may be doped with an element such as phosphorus or aluminum, or an oxide thereof.

In addition, the conductive particles may each be of a laminated configuration comprising a core particle and a covering layer covering the core particle. A material for the core particle is, for example, titanium oxide, barium sulfate, or zinc oxide. A material for the covering layer is, for example, a metal oxide, such as tin oxide.

In addition, when the metal oxide is used as the conductive particles, the volume-average particle diameter of the particles is preferably from 1 nm to 500 nm, more preferably from 3 nm to 400 nm.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further comprise, for example, a concealing agent, such as a silicone oil, resin particles, or titanium oxide.

The average thickness of the conductive layer is preferably from 1 μm to 50 μm, particularly preferably from 3 μm to 40 μm.

The conductive layer may be formed by: preparing a coating liquid for a conductive layer comprising the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent. A dispersion method for the dispersion of the conductive particles in the coating liquid for a conductive layer is, for example, a method comprising using a paint shaker, a sand mill, a ball mill, or a liquid collision-type high-speed dispersing machine.

<Undercoat Layer>

In the present disclosure, an undercoat layer may be arranged on the support or the conductive layer. The arrangement of the undercoat layer can improve an adhesive function between layers to impart a charge injection-inhibiting function.

The undercoat layer preferably comprises a resin. In addition, the undercoat layer may be formed as a cured film by polymerizing a composition comprising a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further comprise an electron-transporting material, a metal oxide, a metal, a conductive polymer, and the like for the purpose of improving electric characteristics. Of those, an electron-transporting material and a metal oxide are preferably used.

Examples of the electron-transporting material include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting material having a polymerizable functional group may be used as the electron-transporting material and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further comprise an additive.

The average thickness of the undercoat layer is preferably from 0.1 μm to 50 μm, more preferably from 0.2 μm to 40 μm, particularly preferably from 0.3 μm to 30 μm.

The undercoat layer may be formed by: preparing a coating liquid for an undercoat layer comprising the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, an ester-based solvent, and an aromatic hydrocarbon-based solvent.

<Photosensitive Layer>

The photosensitive layer of the electrophotographic photosensitive member is mainly classified into (1) a laminated photosensitive layer and (2) a single-layer photosensitive layer. (1) The laminated photosensitive layer comprises a charge-generating layer comprising a charge-generating material and a charge-transporting layer comprising a charge-transporting material. (2) The single-layer photosensitive layer comprises a photosensitive layer comprising both of the charge-generating material and the charge-transporting material.

(1) Laminated Photosensitive Layer

Now, the laminated photosensitive layer is described.

(1-1) Charge-Generating Layer

The charge-generating layer preferably comprises the charge-generating material and a resin.

Examples of the charge-generating material include an azo pigment, a perylene pigment, a polycyclic quinone pigment, an indigo pigment, and a phthalocyanine pigment. Of those, an azo pigment and a phthalocyanine pigment are preferred. Of the phthalocyanine pigments, an oxytitanium phthalocyanine pigment, a chlorogallium phthalocyanine pigment, and a hydroxygallium phthalocyanine pigment are preferred.

The content of the charge-generating material in the charge-generating layer is preferably from 40 mass % to 85 mass %, more preferably from 60 mass % to 80 mass % with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further comprise an additive, such as an antioxidant or a UV absorber. Specific examples thereof include a hindered phenol compound, a hindered amine compound, a sulfur compound, a phosphorus compound, and a benzophenone compound.

The average thickness of the charge-generating layer is preferably from 0.1 μm to 1 μm, more preferably from 0.15 μm to 0.4 μm.

The charge-generating layer may be formed by: preparing a coating liquid for a charge-generating layer comprising the above-mentioned respective materials and a solvent; forming a coating film of the coating liquid; and drying the coating film. Examples of the solvent to be used in the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably comprises the charge-transporting material and a resin.

Examples of the charge-transporting material include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred.

The content of the charge-transporting material in the charge-transporting layer is preferably from 25 mass % to 70 mass %, more preferably from 30 mass % to 55 mass % with respect to the total mass of the charge-transporting layer.

Examples of the resin include a polyester resin, a polycarbonate resin, an acrylic resin, and a polystyrene resin. Of those, a polycarbonate resin and a polyester resin are preferred. As the polyester resin, a polyarylate resin is particularly preferred.

A content ratio (mass ratio) between the charge-transporting material and the resin is preferably from 4:10 to 20:10, more preferably from 5:10 to 12:10.

In addition, the charge-transporting layer may comprise an additive, such as an antioxidant, a UV absorber, a plasticizer, a leveling agent, a lubricity-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge-transporting layer is preferably from κ μm to 50 μm, more preferably from 8 μm to 40 μm, particularly preferably from 10 μm to 30 μm.

The charge-transporting layer may be formed by: preparing a coating liquid for a charge-transporting layer comprising the above-mentioned respective materials and a solvent; forming a coating film of the coating liquid; and drying the coating film. Examples of the solvent to be used in the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

When the charge-transporting layer is the surface layer, the charge-transporting layer comprises the inorganic particles having the pores in their surfaces described above.

(2) Single-Layer Photosensitive Layer

The single-layer photosensitive layer may be formed by: preparing a coating liquid for a photosensitive layer comprising the charge-generating material, the charge-transporting material, a resin, and a solvent; forming a coating film of the coating liquid; and drying the coating film. The charge-generating material, the charge-transporting material, and the resin are the same as the examples of the materials in the above-mentioned section "(1) Laminated Photosensitive Layer".

When the single-layer photosensitive layer is the surface layer, the single-layer photosensitive layer comprises the inorganic particles having the pores in their surfaces described above.

<Protective Layer>

In the present disclosure, a protective layer may be arranged on the photosensitive layer. The arrangement of the protective layer can improve the durability of the photosensitive member.

The protective layer preferably comprises conductive particles and/or the charge-transporting material, and a resin.

Examples of the conductive particles include metal oxide particles, such as titanium oxide, zinc oxide, tin oxide, and indium oxide.

Examples of the charge-transporting material include a polycyclic aromatic compound, a heterocyclic compound, a hydrazone compound, a styryl compound, an enamine compound, a benzidine compound, a triarylamine compound, and a resin having a group derived from any of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition comprising a monomer having a polymerizable functional group. A reaction at that time is, for example, a thermal polymerization reaction, a photopolymerization reaction, or a radiation polymerization reaction. Examples of the polymerizable functional group of the monomer having the polymerizable functional group include an acrylic group and a methacrylic group. A material having a charge-transporting ability may be used as the monomer having the polymerizable functional group.

The protective layer may comprise an additive, such as an antioxidant, a UV absorber, a plasticizer, a leveling agent, a lubricity-imparting agent, or an abrasion resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the protective layer is preferably from 0.5 μm to 10 μm, more preferably from 1 μm to 7 μm.

The protective layer may be formed by: preparing a coating liquid for a protective layer comprising the above-mentioned respective materials and a solvent; forming a coating film of the coating liquid; and drying and/or curing the coating film. Examples of the solvent to be used in the coating liquid include an alcohol-based solvent, a ketone-based solvent, an ether-based solvent, a sulfoxide-based solvent, an ester-based solvent, and an aromatic hydrocarbon-based solvent.

When the protective layer is the surface layer, the protective layer comprises the inorganic particles having the pores in their surfaces described above.

[Process Cartridge and Electrophotographic Image Forming Apparatus]

The electrophotographic photosensitive member of the present disclosure can be supported integrally with at least one unit selected from the group consisting of a charging unit, a developing unit, a transferring unit, and a cleaning unit to form a process cartridge that is removably mounted onto a main body of an electrophotographic image forming apparatus.

In addition, the electrophotographic image forming apparatus of the present disclosure is characterized by comprising the electrophotographic photosensitive member that has heretofore been described, and at least one unit selected from the group consisting of a charging unit, an exposing unit, a developing unit, and a transferring unit.

An example of the schematic construction of an electrophotographic image forming apparatus comprising a process cartridge comprising an electrophotographic photosensitive member is illustrated in FIGURE.

A cylindrical electrophotographic photosensitive member 1 is rotationally driven about a shaft 2 in an arrow direction at a predetermined peripheral speed. The surface of the electrophotographic photosensitive member 1 is charged to a predetermined positive or negative potential by a charging unit 3. Although a roller charging system based on a roller type charging member is illustrated in FIGURE, a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic image forming apparatus. The electrophotographic image forming apparatus may comprise a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic image forming apparatus may comprise an electricity-removing mechanism configured to subject the surface of the electrophotographic photosensitive member 1 to electricity-removing treatment with pre-exposure light 10 from a pre-exposing unit (not shown). In addition, a guiding unit 12, such as a rail, may be arranged for removably mounting a process cartridge 11 onto the main body of an electrophotographic image forming apparatus.

The electrophotographic photosensitive member of the present disclosure may be used in, for example, a laser beam printer, an LED printer, a copying machine, a facsimile, and a multifunctional peripheral thereof.

According to the present disclosure, there can be provided the electrophotographic photosensitive member that can be reduced in abrasion amount even when the inorganic particles are used.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

Production Example of Coating Liquid for Surface Layer

Production Example of Coating Liquid 1 for Surface Layer 5.6 Parts of a compound (charge-transporting material (hole-transportable compound)) represented by the structural formula (A-1), 0.6 part of a compound (charge-transporting material (hole-transportable compound)) represented by the structural formula (A-2), 10 parts of a polyester resin B1 (weight-average molecular weight: 12,000) having a structural unit represented by the structural formula (B-1), 30 parts of o-xylene, 20 parts of methyl benzoate, and 50 parts of dimethoxymethane (methylal) were mixed, and after the mixing, the mixture was filtered with a filter. The filtrate had a viscosity of 490 mPa·s. After that, 0.8 part of silica particles having an average primary particle diameter of 3 μm (product name: SUNSPHERE H-31, manufactured by AGC Inc.) were added to the filtrate, and the mixture was stirred, followed by uniform dispersion of the particles in the filtrate with an ultrasonic homogenizer. The dispersion liquid was transferred to a container whose inside was able to be decompressed, and the inside was decompressed with a pump. A pressure in the container was maintained at 0.017 MPa for a time period of 10 minutes. The resultant coating liquid is defined as "a coating liquid 1 for a surface layer." Details about a method of producing the coating liquid are shown in Table 2.

(A-1)

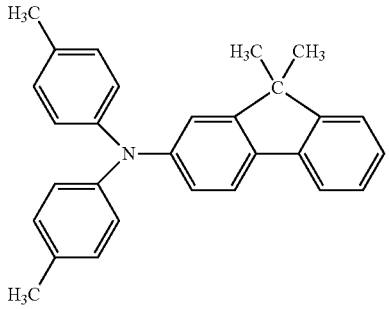

(A-2)

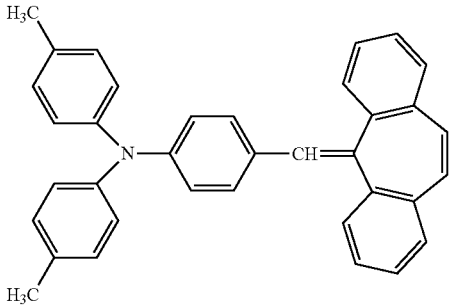

(B-1)

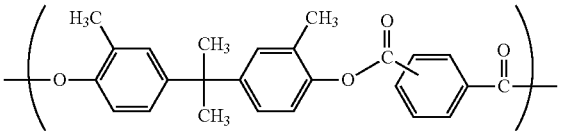

Production Examples of Coating Liquid 2 for Surface Layer to Coating Liquid 8 for Surface Layer, Coating Liquid 11 for Surface Layer to Coating Liquid 14 for Surface Layer, and Coating Liquid 101 for Surface Layer to Coating Liquid 106 for Surface Layer Coating liquids for charge-transporting layers were each produced in exactly the same manner as in the production example of the coating liquid 1 for a surface layer except that the charge-transporting materials, the resin, the inorganic particles, and the decompression conditions were changed as shown in Table 2. Details are shown in Table 2. Details about the used inorganic particles are shown in Table 1. The resultant coating liquids for charge-transporting layers are defined as "a coating liquid 2 for a surface layer to a coating liquid 8 for a surface layer, a coating liquid 11 for a surface layer to a coating liquid 14 for a surface layer, and a coating liquid 101 for a surface layer to a coating liquid 106 for a surface layer."

Production Examples of Coating Liquid 9 for Surface Layer and Coating Liquid 10 for Surface Layer Coating liquids for charge-transporting layers were each produced in exactly the same manner as in the production example of the coating liquid 1 for a surface layer except that: the resin B1 was changed to a resin B2, which had the structural unit represented by the structural formula (B-1) and a structural unit represented by the structural formula (B-2), had a ratio (mass ratio) "(B-1)/(B-2)" between the repeating structural units of 7/3, and had a weight-average molecular weight of 12,000; and the charge-transporting materials, the inorganic particles, and the decompression conditions were changed as shown in Table 2. Details about the used inorganic particles are shown in Table 1. The resultant coating liquids for charge-transporting layers are defined as "a coating liquid 9 for a surface layer and a coating liquid 10 for a surface layer."

(B-2)

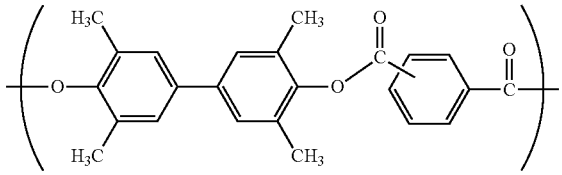

Production Example of Coating Liquid 15 for Surface Layer 4.2 Parts of the compound (charge-transporting material (hole-transportable compound)) represented by the structural formula (A-1), 0.45 part of the compound (charge-transporting material (hole-transportable compound)) represented by the structural formula (A-2), 6 parts of the polyester resin B1 (weight-average molecular weight: 12,000) comprising the structural unit represented by the structural formula (B-1), 30 parts of o-xylene, and 20 parts of methyl benzoate were mixed, and after the mixing, the mixture was filtered with a filter. After that, 0.6 part of silica particles having an average primary particle diameter of 3 μm (product name: SUNSPHERE H-31, manufactured by AGC Inc.) were added to the filtrate, and the mixture was stirred, followed by uniform dispersion of the particles in the filtrate with an ultrasonic homogenizer. The dispersion liquid had a viscosity of 498 mPa·s. The dispersion liquid was transferred to a container whose inside was able to be decompressed, and the inside was decompressed with a pump. A pressure in the container was maintained at 0.017 MPa for 15 minutes. The dispersion liquid was removed from the decompression container, and 50 parts of dimethoxymethane (methylal) was added thereto, followed by stirring. The resultant coating liquid is defined as "a coating liquid 15 for a surface layer."

Production Example of Coating Liquid 107 for Surface Layer

60 Parts of a compound (charge-transporting material (hole-transportable compound)) represented by the structural formula (A-3), 2 parts of a hindered phenol-based antioxidant ("IRGANOX 1010" manufactured by BASF SE), 100 parts of a resin B3 having a structural unit represented by the structural formula (B-3) and having a viscosity-average molecular weight of 45,000, 0.6 part of a silicone oil (product name: KF-96-50CS, manufactured by Shin-Etsu Chemical Co., Ltd.), 5 parts of silica particles (P-9), 350 parts of tetrahydrofuran, and 350 parts of toluene were mixed. Subsequently, mixing with an ultrasonic homogenizer was performed to disperse the materials in the solvent. The resultant coating liquid for a charge-transporting layer is defined as "a coating liquid 107 for a surface layer."

(A-3)

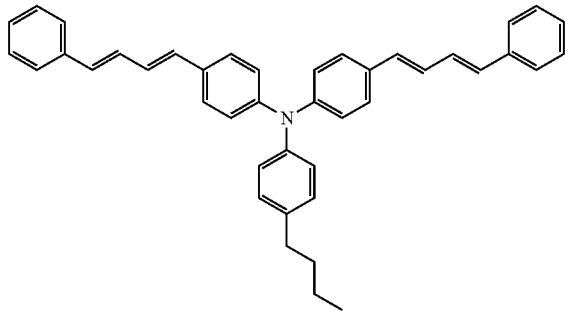

(B-3)

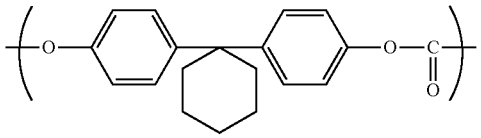

TABLE 1

| Particle No. | Average primary particle diameter [μm] | Material | Specific surface area [$m^2/g$] | Pore volume [mL/g] | Pore diameter [nm] | Product name | Manufacturer |
|---|---|---|---|---|---|---|---|
| P-1 | 3 | Silica | 800 | 1 | 5 | SUNSPHERE H-31 | Manufactured by AGC Inc. |
| P-2 | 5 | Silica | 800 | 1 | 5 | SUNSPHERE H-51 | Manufactured by AGC Inc. |
| P-3 | 3 | Silica | 700 | 2 | 10 | SUNSPHERE H-32 | Manufactured by AGC Inc. |
| P-4 | 5 | Silica | 800 | 2 | 10 | SUNSPHERE H-52 | Manufactured by AGC Inc. |
| P-5 | 3 | Silica | 300 | 1 | 13 | SUNSPHERE L-31 | Manufactured by AGC Inc. |
| P-6 | 12 | Silica | 800 | 1 | 5 | SUNSPHERE H-121 | Manufactured by AGC Inc. |
| P-7 | 3 | Silica | 600 | | 3 | CARiACT G-3 | Manufactured by Fuji Silysia Chemical Ltd. |
| P-8 | 3 | Silica | 500 | | 6 | CARiACT G-6 | Manufactured by Fuji Silysia Chemical Ltd. |
| P-9 | 0.012 | Silica | 140 | — | — | AEROSIL R3C200 | Manufactured by Evonik Industries AG |
| P-10 | 4 | Silica | 40 | 0.05 | | SUNSPHERE NP-30 | Manufactured by AGC Inc. |

TABLE 2

| | Charge-transporting material | | Resin | | Solvent 1 | | |
|---|---|---|---|---|---|---|---|
| | Compound | Part (s) by mass | Resin β | Part (s) by mass | | Part (s) by mass | Solvent 2 |
| Coating liquid 1 for surface layer | A-1/A-2 | 5.6/0.6 | Resin B1 | 8 | Xylene | 30 | Methyl benzoate |
| Coating liquid 2 for surface layer | A-1/A-2 | 5.6/0.6 | Resin B1 | 8 | Xylene | 30 | Methyl benzoate |
| Coating liquid 3 for surface layer | A-1/A-2 | 5.6/0.6 | Resin B1 | 8 | Xylene | 30 | Methyl benzoate |
| Coating liquid 4 for surface layer | A-1/A-2 | 5.6/0.6 | Resin B1 | 8 | Xylene | 30 | Methyl benzoate |
| Coating liquid 5 for surface layer | A-1/A-2 | 5.6/0.6 | Resin B1 | 8 | Xylene | 30 | Methyl benzoate |

TABLE 2-continued

| | | | | | | | |
|---|---|---|---|---|---|---|---|
| Coating liquid 6 for surface layer | A-1/A-7 | 5.6/0.6 | Resin B1 | 8 | Xylene | 30 | Methyl benzoate |
| Coating liquid 7 for surface layer | A-1/A-2 | 5.6/0.6 | Resin B1 | 8 | Xylene | 30 | Methyl benzoate |
| Coating liquid 8 for surface layer | A-1/A-2 | 5.6/0.6 | Resin B1 | 8 | Xylene | 30 | Methyl benzoate |
| Coating liquid 9 for surface layer | A-1/A-2 | 5.6/0.6 | Resin B1 | 8 | Xylene | 30 | Methyl benzoate |
| Coating liquid 10 for surface layer | A-1/A-2 | 5.6/0.6 | Resin B2 | 8 | Xylene | 30 | Methyl benzoate |
| Coating liquid 11 for surface layer | A-1/A-2 | 5.6/0.6 | Resin B1 | 8 | Xylene | 30 | Methyl benzoate |
| Coating liquid 12 for surface layer | A-1/A-2 | 5.6/0.6 | Resin B1 | 8 | Xylene | 30 | Methyl benzoate |
| Coating liquid 13 for surface layer | A-1/A-2 | 5.6/0.6 | Resin B1 | 8 | Xylene | 30 | Methyl benzoate |
| Coating liquid 14 for surface layer | A-1/A-2 | 5.6/0.6 | Resin B1 | 8 | Xylene | 30 | Methyl benzoate |
| Coating liquid 15 for surface layer | A-1/A-2 | 4.2/0.45 | Resin B1 | 8 | Xylene | 30 | Methyl benzoate |
| Coating liquid 101 for surface layer | A-1/A-2 | 5.6/0.6 | Resin B1 | 8 | Xylene | 30 | Methyl benzoate |
| Coating liquid 102 for surface layer | A-1/A-2 | 5.6/0.6 | Resin B1 | 8 | Xylene | 30 | Methyl benzoate |
| Coating liquid 103 for surface layer | A-1/A-2 | 5.6/0.6 | Resin B1 | 8 | Xylene | 30 | Methyl benzoate |
| Coating liquid 104 for surface layer | A-1/A-2 | 5.6/0.6 | Resin B1 | 8 | Xylene | 30 | Methyl benzoate |
| Coating liquid 105 for surface layer | A-1/A-2 | 5.6/0.6 | Resin B1 | 8 | Xylene | 30 | Methyl benzoate |
| Coating liquid 106 for surface layer | A-1/A-2 | 5.6/0.6 | Resin B1 | 8 | Xylene | 30 | Methyl benzoate |
| Coating liquid 107 for surface layer | A-3 | 60 | Resin B3 | 100 | THF | 350 | Toluene |

| | Solvent 2 | Solvent 3 | | Inorganic particles | | | |
|---|---|---|---|---|---|---|---|
| | Part (s) by mass | | Part (s) by mass | Particle No. | Part (s) by mass | Pressure [MPa] | Decompression time [min] |
| Coating liquid 1 for surface layer | 20 | Dimethoxymethane | 50 | P-1 | 0.8 | 0.017 | 10 |
| Coating liquid 2 for surface layer | 20 | Dimethoxymethane | 50 | P-2 | 0.8 | 0.03 | 10 |

TABLE 2-continued

| | | | | | | | |
|---|---|---|---|---|---|---|---|
| Coating liquid 3 for surface layer | 20 | Dimethoxymethane | 50 | P-3 | 0.8 | 0.03 | 10 |
| Coating liquid 4 for surface layer | 20 | Dimethoxymethane | 50 | P-4 | 0.8 | 0.04 | 10 |
| Coating liquid 5 for surface layer | 20 | Dimethoxymethane | 50 | P-5 | 0.8 | 0.03 | 10 |
| Coating liquid 6 for surface layer | 20 | Dimethoxymethane | 50 | P-6 | 0.8 | 0.03 | 10 |
| Coating liquid 7 for surface layer | 20 | Dimethoxymethane | 50 | P-7 | 0.8 | 0.02 | 10 |
| Coating liquid 8 for surface layer | 20 | Dimethoxymethane | 50 | P-8 | 0.8 | 0.03 | 10 |
| Coating liquid 9 for surface layer | 20 | Dimethoxymethane | 50 | P-1 | 0.8 | 0.03 | 10 |
| Coating liquid 10 for surface layer | 20 | Dimethoxymethane | 50 | P-3 | 0.8 | 0.03 | 10 |
| Coating liquid 11 for surface layer | 20 | Dimethoxymethane | 50 | P-1 | 0.8 | 0.06 | 10 |
| Coating liquid 12 for surface layer | 20 | Dimethoxymethane | 50 | P-1 | 0.8 | 0.018 | 15 |
| Coating liquid 13 for surface layer | 20 | Dimethoxymethane | 50 | P-1 | 0.8 | 0.018 | 8 |
| Coating liquid 14 for surface layer | 20 | Dimethoxymethane | 50 | P-1 | 2.5 | 0.018 | 10 |
| Coating liquid 15 for surface layer | 20 | Dimethoxymethane | 50 | P-1 | 0.6 | 0.017 | 15 |
| Coating liquid 101 for surface layer | 20 | Dimethoxymethane | 50 | P-9 | 0.8 | 0.018 | 10 |
| Coating liquid 102 for surface layer | 20 | Dimethoxymethane | 50 | P-10 | 0.8 | 0.018 | 10 |
| Coating liquid 103 for surface layer | 20 | Dimethoxymethane | 50 | P-1 | 0.8 | — | — |
| Coating liquid 104 for surface layer | 20 | Dimethoxymethane | 50 | P-10 | 0.8 | — | — |
| Coating liquid 105 for surface layer | 20 | Dimethoxymethane | 50 | P-7 | 0.8 | — | — |
| Coating liquid 106 for surface layer | 20 | Dimethoxymethane | 50 | P-8 | 0.8 | — | — |
| Coating liquid 107 for surface layer | 350 | | | P-10 | 4 | — | — |

<Method of Producing Electrophotographic Photosensitive Member 1>

An aluminum cylinder having a diameter of 30 mm and a length of 357.5 mm was adopted as a support (cylindrical support).

Next, 60 parts of barium sulfate particles coated with tin oxide (product name: PASTRAN PCI, manufactured by Mitsui Mining & Smelting Co., Ltd.), 15 parts of titanium oxide particles (product name: TITANIX JR, manufactured by Tayca Corporation), 43 parts of a resol-type phenol resin (product name: PHENOLITE J-325, manufactured by DIC Corporation (former Dainippon Ink & Chemicals, Inc.), solid content: 70 mass %), 0.015 part of a silicone oil (product name: SH28PA, manufactured by Dow Corning Toray Co., Ltd. (former Toray Silicone Co., Ltd.)), 3.6 parts of silicone resin particles (product name: TOSPEARL 120, manufactured by Momentive Performance Materials Japan LLC (former Toshiba Silicone Co., Ltd.)), 50 parts of 2-methoxy-1-propanol, and 50 parts of methanol were loaded into a ball mill, and were subjected to dispersion treatment for 20 hours to prepare a coating liquid for a conductive layer. The coating liquid for a conductive layer was applied onto the support by dip coating, and the resultant coating film was heated for 1 hour at 140° C. to be cured. Thus, a conductive layer having a thickness of 30 μm was formed.

Next, 10 parts of copolymerized nylon (product name: AMILAN CM8000, manufactured by Toray Industries, Inc.) and 30 parts of a methoxymethylated 6-nylon resin (product name: TORESIN EF-30T, manufactured by Nagase ChemteX Corporation (former Teikoku Kagaku Sangyo K.K.)) were dissolved in a mixed solvent comprising 400 parts of methanol and 200 parts of n-butanol to prepare a coating liquid for an undercoat layer. The coating liquid for an undercoat layer was applied onto the conductive layer by dip coating, and the resultant coating film was dried for 30 minutes at 100° C. to form an undercoat layer having a thickness of 0.8 μm.

Next, 20 parts of a hydroxygallium phthalocyanine crystal (charge-generating material) of a crystal form having strong peaks at Bragg angles 20±0.2° in CuKβ characteristic X-ray diffraction of 7.4° and 28.2°, 0.2 part of a calixarene compound represented by the structural formula (1), 10 parts of polyvinyl butyral (product name: S-LEC BX-1, manufactured by Sekisui Chemical Co., Ltd.), and 600 parts of cyclohexanone were loaded into a sand mill using glass beads each having a diameter of 1 mm. Then, the materials were subjected to dispersion treatment for 4 hours, and then 700 parts of ethyl acetate was added to the treated product to prepare a coating liquid for a charge-generating layer. The coating liquid for a charge-generating layer was applied onto the undercoat layer by dip coating, and the resultant coating film was dried for 15 minutes at 80° C. to form a charge-generating layer having a thickness of 0.17μm.

(1)

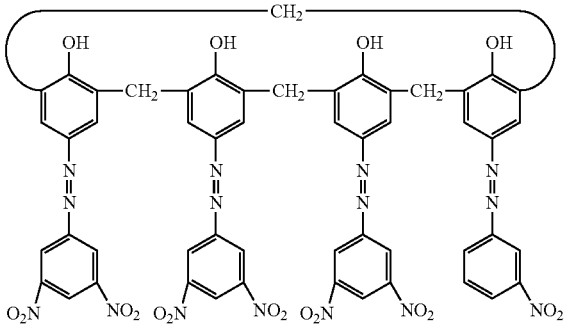

Next, "the coating liquid 1 for a surface layer" was applied onto the charge-generating layer by dip coating to form a coating film, and the resultant coating film was dried for 50 minutes at 120° C. to form a charge-transporting layer (surface layer) having a thickness of 20 μm.

Details about the production method are shown in Table 3. The column "Thickness" in Table 3 shows the thickness of the charge-transporting layer (surface layer). The resultant electrophotographic photosensitive member is defined as "a photosensitive member 1."

<Methods of Producing Electrophotographic Photosensitive Members 2 to 17>

Electrophotographic photosensitive members were each produced in exactly the same manner as in the method of producing the photosensitive member 1 except that: a coating liquid for a surface layer shown in Table 3 was used; and the thickness of the surface layer was adjusted to a thickness shown in Table 3. The resultant electrophotographic photosensitive members are defined as "a photosensitive member 2 to a photosensitive member 17." Details are shown in the table.

<Methods of Producing Electrophotographic Photosensitive Members 101 to 107>

Electrophotographic photosensitive members were each produced in exactly the same manner as in the method of producing the photosensitive member 1 except that: a coating liquid for a surface layer shown in Table 3 was used; and the thickness of the surface layer was adjusted to a thickness shown in Table 3. The resultant electrophotographic photosensitive members are defined as "a photosensitive member 101 to a photosensitive member 107." Details about the production method are shown in Table 3.

[Evaluation]

A 10-millimeter square piece was cut out of the surface layer at a position distant from the upper end of the resultant photosensitive member 1 by 180 mm. Pt—Pd sputtering was performed from the surface side of the piece, and then the piece was protected with a photocurable resin and a cover glass, followed by the irradiation of the protected piece with an ion beam from an ion beam irradiation apparatus (product name: IM4000, manufactured by Hitachi High-Technologies Corporation). Thus, a sample was produced.

The observation of a section of the surface layer with a scanning electron microscope (product name: SU8220, manufactured by Hitachi High-Technologies Corporation) recognized that the resin penetrated the inside of the pores of the surfaces of the inorganic particles. The result is shown in Table 3. In the column "Penetration" in Table 3, a case in which the resin penetrated the inside of the pores of the surfaces of the inorganic particles was represented by "present", and a case in which the resin did not penetrate the inside was represented by "absent".

As described above, a measurement sample measuring 20 μm thick by 5 mm wide by 20 mm long was cut out of the surface layer of the photosensitive member 1. The tan δ of the sample was measured by applying, to the sample, vibration having a frequency of 0.5 Hz at 28° C. with a viscoelasticity spectrometer (product name: EXSTAR DMS6100, manufactured by SII Nano Technology Inc.). The tan δ was 0.020.

The photosensitive member 1 was newly prepared, and was mounted on the cyan station of a reconstructed machine of an electrophotographic apparatus (copying machine) (product name: iR-ADV C5560F, manufactured by Canon Inc.), which was an evaluation apparatus, followed by the performance of an image evaluation as described below.

Under an environment at 23° C. and 5% RH, the cyan station of the evaluation apparatus was placed, and conditions for a charging apparatus and an image exposing apparatus were set so that the dark portion potential (Vd) and light portion potential (Vl) of the electrophotographic photosensitive member became −700 V and −200 V, respectively, thereby adjusting the initial potential of the electrophotographic photosensitive member.

Next, a screen image having a cyan density of 30% was output as a halftone image, and it was recognized that the image was a satisfactory image free of an image defect derived from a deep flaw of the photosensitive member.

After that, an evaluation chart having an A4 horizontal 5% image was output on 50,000 sheets of paper in a 5-sheet intermittent manner under the above-mentioned conditions. A reduction in thickness of the surface layer of the used photosensitive member (shaved amount due to long-term use) was measured by measuring the thickness with a multi-channel spectrometer (product name: MCPD-9800/916C, manufactured by Otsuka Electronics Co., Ltd.). The shaved amount was 3.2 μm. Subsequently, a halftone image having a cyan density of 30%, which had been formed by a screen pattern, was output, and the presence or absence of an image defect derived from a deep flaw of the photosensitive member was judged by comparing the image to the photosensitive member. As a result, no image defect derived from the deep flaw was observed.

<Evaluations of Photosensitive Members 2 to 17 and Photosensitive Members 101 to 107>

Evaluations were performed in the same manner as in the evaluations of the photosensitive member 1. Evaluation criteria for a shaved amount and an image defect are described below, and the results are shown in Table 3. With regard to the shaved amount evaluation, ranks A to C are acceptable ranges, and with regard to the image defect evaluation, ranks A and B are acceptable ranges.

(Shaved Amount)

A: Less than 3.5 μm

B: 3.5 μm or more and less than 5.0 μm

C: 5.0 μm or more and less than 6.0 μm

D: 6.0 μm or more (Image Defect)

A: No image defect derived from a deep flaw is present.

B: An extremely slight image defect derived from a deep flaw was observed, but falls within an acceptable range in terms of image quality.

C: An image defect derived from a deep flaw occurred.

TABLE 3

| | Coating liquid for surface layer | Drying temperature [° C.] | Drying time [min] | Thickness [μm] | Penetration | tanδ | Shaved amount [μm] | Shaved amount evaluation | Image evaluation |
|---|---|---|---|---|---|---|---|---|---|
| Photosensitive member 1 | 1 | 120 | 50 | 20 | Present | 0.02 | 3.2 | A | A |
| Photosensitive member 2 | 2 | 120 | 50 | 20 | Present | 0.01 | 2.9 | A | A |
| Photosensitive member 3 | 3 | 120 | 50 | 20 | Present | 0.03 | 3 | A | A |
| Photosensitive member 4 | 4 | 120 | 50 | 20 | Present | 0.02 | 3.3 | A | A |
| Photosensitive member 5 | 5 | 120 | 50 | 20 | Present | 0.02 | 3.4 | A | A |
| Photosensitive member 6 | 6 | 120 | 50 | 20 | Present | 0.005 | 5.1 | C | B |
| Photosensitive member 7 | 7 | 120 | 50 | 20 | Present | 0.006 | 4.8 | B | B |
| Photosensitive member 8 | 8 | 120 | 50 | 20 | Present | 0.005 | 4.5 | B | B |
| Photosensitive member 9 | 1 | 120 | 30 | 20 | Present | 0.02 | 2.8 | A | A |
| Photosensitive member 10 | 3 | 120 | 30 | 20 | Present | 0.03 | 2.9 | A | A |
| Photosensitive member 11 | 9 | 120 | 50 | 20 | Present | 0.03 | 2.8 | A | A |
| Photosensitive member 12 | 10 | 120 | 30 | 20 | Present | 0.05 | 3 | A | A |
| Photosensitive member 13 | 11 | 120 | 50 | 20 | Present | 0.007 | 4.3 | B | B |
| Photosensitive member 14 | 12 | 120 | 50 | 20 | Present | 0.03 | 2.9 | A | A |
| Photosensitive member 15 | 13 | 120 | 50 | 20 | Present | 0.005 | 4.7 | B | B |
| Photosensitive member 16 | 14 | 120 | 50 | 10 | Present | 0.01 | 3 | A | A |
| Photosensitive member 17 | 15 | 120 | 50 | 20 | Present | 0.03 | 3.4 | A | A |
| Photosensitive member 101 | 101 | 120 | 50 | 20 | Absent | 0.002 | 6.1 | D | C |
| Photosensitive member 102 | 102 | 120 | 50 | 20 | Absent | 0.002 | 6.4 | D | C |
| Photosensitive member 103 | 103 | 120 | 50 | 20 | Absent | 0.001 | 6.8 | D | C |
| Photosensitive member 104 | 104 | 120 | 50 | 20 | Absent | 0.001 | 6.9 | D | C |
| Photosensitive member 105 | 105 | 120 | 50 | 20 | Absent | 0.001 | 6.2 | D | C |

TABLE 3-continued

| | Coating liquid for surface layer | Drying temperature [° C.] | Drying time [min] | Thickness [μm] | Penetration | tanδ | Shaved amount [μm] | Shaved amount evaluation | Image evaluation |
|---|---|---|---|---|---|---|---|---|---|
| Photosensitive member 106 | 106 | 120 | 50 | 20 | Absent | 0.001 | 6.4 | D | C |
| Photosensitive member 107 | 107 | 120 | 40 | 30 | Absent | 0.001 | 6.9 | D | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-061525, filed Mar. 30, 2020, which is hereby incorporated by reference herein in its entirety.

What is claimed is:

1. An electrophotographic photosensitive member comprising:

a support; and a surface layer formed on the support, wherein the surface layer comprises inorganic particles having pores in surfaces thereof and a resin, the resin in the surface layer penetrates the pores, and when vibration having a frequency of 0.5 Hz is applied to the surface layer at 28° C., a loss tangent tan δ of dynamic viscoelasticity of the surface layer is from 0.005 to 0.05.

2. The electrophotographic photosensitive member according to claim 1, wherein the loss tangent tan δ of the dynamic viscoelasticity of the surface layer when the vibration having a frequency of 0.5 Hz is applied thereto at 28° C. is from 0.01 to 0.05.

3. The electrophotographic photosensitive member according to claim 1, wherein the inorganic particles have an average primary particle diameter of from 1 μm to 6 μm.

4. The electrophotographic photosensitive member according to claim 1, wherein the inorganic particles have a specific surface area of from 300 $m^2/g$ to 1,000 $m^2/g$.

5. A method of producing an electrophotographic photosensitive member comprising a support and a surface layer formed on the support, the method comprising:

deaerating a coating liquid for a surface layer under a decompressed state; and forming a coating film through use of the coating liquid for a surface layer that has been deaerated, followed by drying and/or curing of the coating film to form the surface layer, wherein the coating liquid for a surface layer comprises inorganic particles having pores in surfaces thereof.

6. The method of producing an electrophotographic photosensitive member according to claim 5, wherein the decompressed state is a state in which a pressure surrounding the coating liquid is 0.05 MPa or less.

7. The method of producing an electrophotographic photosensitive member according to claim 5, wherein the deaeration is performed for a time period of 10 minutes or more.

8. The method of producing an electrophotographic photosensitive member according to claim 5, wherein the inorganic particles have an average primary particle diameter of from 1 μm to 6 μm.

9. The method of producing an electrophotographic photosensitive member according to claim 5, wherein the inorganic particles have a specific surface area of from 300 $m^2/g$ to 1,000 $m^2/g$.

10. An electrophotographic image forming apparatus comprising:

an electrophotographic photosensitive member; and at least one unit selected from the group consisting of a charging unit, an exposing unit, a developing unit, and a transferring unit, wherein the electrophotographic photosensitive member comprises a support and a surface layer formed on the support, the surface layer comprises inorganic particles having pores in surfaces thereof and a resin, the resin in the surface layer penetrates the pores, and when vibration having a frequency of 0.5 Hz is applied to the surface layer at 28° C., a loss tangent tan δ of dynamic viscoelasticity of the surface layer is from 0.005 to 0.05.

* * * * *